US010285885B2

(12) United States Patent
Baker, Jr. et al.

(10) Patent No.: US 10,285,885 B2
(45) Date of Patent: May 14, 2019

(54) MEDICAL APPARATUS COVER

(71) Applicant: Stryker Corporation, Kalamazoo, MI (US)

(72) Inventors: Charles Donald Baker, Jr., Portage, MI (US); Matthew Thomas Thielking, Schoolcraft, MI (US); Ryan Ross, Lawton, MI (US); Venkata Ravi Varma Mudunuri, Kalamazoo, MI (US); Jason Michael Paul, Kalamazoo, MI (US); Tyler Scott Wright, Kalamazoo, MI (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 15/371,492

(22) Filed: Dec. 7, 2016

(65) Prior Publication Data

US 2017/0181909 A1 Jun. 29, 2017

Related U.S. Application Data

(60) Provisional application No. 62/387,252, filed on Dec. 23, 2015.

(51) Int. Cl.
*A61G 7/05* (2006.01)
*A61G 7/018* (2006.01)

(52) U.S. Cl.
CPC ..... *A61G 7/0522* (2016.11); *A61G 7/018* (2013.01); *A61G 7/052* (2016.11); *A61G 7/0507* (2013.01);
(Continued)

(58) Field of Classification Search
CPC .... A61G 7/0507; A61G 7/052; A61G 7/0512; A61G 7/0513; A61G 7/0522;
(Continued)

(56) References Cited

U.S. PATENT DOCUMENTS 3,480,402 A * 11/1969 Jackson ..... G01K 3/04 116/206
3,742,530 A * 7/1973 Clark ..... A61G 7/0507 297/219.1
(Continued)

FOREIGN PATENT DOCUMENTS

AU 749862 B2 2/1999
AU 745990 B2 4/2002
(Continued)

OTHER PUBLICATIONS

Coatings, Time-sensitive/reactive inks or dyes posts, Jul. 9, 2004.

*Primary Examiner* — Robert G Santos
*Assistant Examiner* — David R Hare
(74) *Attorney, Agent, or Firm* — Warner Norcross + Judd LLP

(57) ABSTRACT

A cover for covering a portion of a hospital bed barrier that includes a sheet of material that has sufficient flexibility and elasticity to stretch from a first configuration to a second configuration. When in the first configuration, the cover is insufficient in size to cover at least a portion of a hospital bed barrier and, when in the second configuration, the cover is sufficient in size to cover at least a portion of a hospital bed barrier.

22 Claims, 5 Drawing Sheets

(52) U.S. Cl.
CPC ..... *A61G 7/0513* (2016.11); *A61G 2205/10* (2013.01); *A61G 2205/60* (2013.01)

(58) Field of Classification Search
CPC ..... A61G 7/0524; A61G 7/018; A61G 7/015; A61G 7/0514; A61G 7/005; A61G 7/012; A61G 7/0516; A61G 2205/10; A61G 2205/20; A61G 2205/30; A61G 2205/60; A47C 21/08; G08B 21/182
See application file for complete search history.

(56) References Cited

U.S. PATENT DOCUMENTS 4,215,446 A * 8/1980 Mahoney ..... A47C 21/08 248/345.1
4,370,765 A * 2/1983 Webber ..... A47C 21/08 5/427
4,827,545 A * 5/1989 Arp ..... A47C 21/08 5/424
5,044,025 A * 9/1991 Hunsinger ..... A61G 7/0507 5/424
5,097,550 A * 3/1992 Marra, Jr. ..... A61G 7/05 5/424
5,175,897 A * 1/1993 Marra, Jr. ..... A61G 7/05 5/425
5,191,663 A * 3/1993 Holder ..... A61G 7/05 5/424
5,481,772 A * 1/1996 Glynn ..... A61G 7/0507 5/663
5,557,817 A * 9/1996 Haddock ..... A61G 7/0507 5/425
5,602,804 A 2/1997 Haas
5,890,244 A * 4/1999 Cartwright ..... A61G 7/0522 5/663
5,898,964 A 5/1999 Stanley
5,911,654 A * 6/1999 Webb ..... A47C 17/14 5/424
5,930,206 A * 7/1999 Haas ..... G04F 1/00 116/200
5,957,458 A 9/1999 Haas et al.
6,021,533 A * 2/2000 Ellis ..... A61G 7/0507 5/425
6,038,721 A * 3/2000 Gordon ..... A61G 7/0507 5/424
6,208,250 B1 * 3/2001 Dixon ..... A61G 7/05 340/539.12
6,452,873 B1 9/2002 Holt et al.
6,629,325 B2 * 10/2003 Heavrin ..... A61G 7/053 5/662
7,028,352 B2 * 4/2006 Kramer ..... A61G 7/05 428/430
7,290,654 B2 * 11/2007 Hodges ..... H01H 9/0242 206/320
7,817,498 B1 * 10/2010 Hinckley ..... G04F 13/06 368/10
8,239,986 B2 * 8/2012 Heimbrock ..... A61G 7/0507 5/425
8,605,892 B1 * 12/2013 Owens ..... A45C 13/002 379/439
2004/0050750 A1 3/2004 Hannan et al.
2004/0064885 A1 4/2004 Moster et al.
2011/0214234 A1 * 9/2011 Herman ..... A61G 7/0507 5/600
2013/0253291 A1 * 9/2013 Dixon ..... A47C 21/00 600/323
2014/0236629 A1 * 8/2014 Kim ..... G06Q 50/24 705/3
2014/0259389 A1 * 9/2014 Hillenbrand, II .... A47G 9/0238 5/81.1 HS
2016/0120716 A1 * 5/2016 Ribble ..... A61B 5/6892 5/616
2016/0338891 A1 * 11/2016 Agdeppa ..... A61G 7/015

FOREIGN PATENT DOCUMENTS

CA 2094279 C 4/1999
DE 69511563 T2 3/2000
DE 69822477 T2 1/2005
EP 0906591 A1 4/1999
EP 0917673 B1 9/2005
EP 1210653 B1 6/2008
EP 2303129 B1 8/2013
GB 2482591 A 8/2012

* cited by examiner

MEDICAL APPARATUS COVER

CROSS-REFERENCE TO RELATED APPLICATION

This application claims the benefit of U.S. Provisional Patent Application No. 62/387,252, filed on Dec. 23, 2015 which is incorporated herein by reference in its entirety.

TECHNICAL FIELD AND BACKGROUND

The present disclosure relates to a cover for a medical apparatus, and more particularly to a cover for a patient support apparatus barrier, such as a side rail.

Infection control is a high priority for all medical facilities. Transmission is usually controlled through regular cleaning of the surfaces of medical equipment using conventional cleaning products. However, despite careful efforts when using conventional cleaning products, bacteria and viruses can remain on a surface due to seams and other variations in the surface where the cleaning products may not reach. Further, medical apparatuses with frequent shared touch points, such as patient support apparatus barriers, generally pose a greater risk of transmission.

Accordingly, there is a continuing need to improve ways to control transmission of bacteria and/or viruses, especially on patient support apparatus barriers with which caregivers and patients frequently make contact.

SUMMARY

Accordingly, the present disclosure describes a cover that is easy to install, removable, and, further, disposable to provide a sterile barrier between a patient and a component of a patient support apparatus.

In one embodiment, a cover for covering at least a portion of a patient support apparatus, such as a hospital bed barrier, includes a sheet of material having sufficient flexibility and elasticity to stretch from a first configuration to a second configuration. When in the first configuration, the cover is insufficient in size to cover the hospital bed barrier. When in the second configuration, the cover is sufficient in size to cover at least a portion of the hospital bed barrier. For example, the hospital bed barrier may be a hospital bed side rail, such as a head-end side rail.

In one aspect, the material comprises nitrile, such as nitrile rubber, or latex.

In another aspect, the sheet is color-coded, for example to provide a functional flag. For example, the color may indicate a condition of the patient.

In another aspect, the cover may include an electronic tag, such as an RFID tag.

According to yet another aspect, the sheet includes a chemical, which has a first state and a second state and which changes between the first state and the second state in response to an input. For example, the input may comprise a passage of time.

In a further aspect, the chemical emits a first color in the first state and emits a second color in the second state.

In yet another aspect, the sheet may (1) be transparent or translucent, (2) include a scent, (3) be disposable, and/or (4) include a luminescent material.

In another aspect, the sheet has a thickness in a range of 3 mils to 12 mils.

In another embodiment, a patient support apparatus includes a support surface, a barrier mounted adjacent the support surface, and a cover mounted over at least a portion of the barrier. The cover comprises a sheet of material having sufficient flexibility and elasticity to stretch from a first configuration to a second configuration wherein when in the first configuration the cover is insufficient in size to cover the portion of the barrier, and when in the second configuration the cover is sufficient in size to cover the portion of the barrier.

In one aspect, the barrier includes a body and a mounting mechanism for mounting the body adjacent the support surface. When in the second configuration, the cover is sufficient in size to cover a portion of the body of the barrier.

In another aspect, the cover is sufficient in size to cover two opposed sides of the body of the barrier when in the second configuration.

In yet another aspect, the patient support apparatus further includes a controller. The controller is configured to detect when the cover is mounted to the barrier. For example, the barrier may include a sensor, such as an optical sensor or an image sensor, in communication with the controller to detect when the cover is mounted to the barrier.

In another aspect, the controller is configured to monitor how long the cover has been mounted to the barrier based on signals from the sensor.

In yet a further aspect, the controller is configured to generate a signal when the cover has been mounted to the barrier for a preselected period of time or when the cover has been mounted to the barrier for a time period that exceeds a preselected period of time.

Alternately, or in addition, the controller is configured to generate an alarm when the cover has been mounted to the barrier for a preselected period of time or when the cover has been mounted to the barrier for a time period that exceeds a preselected period of time.

In another aspect, the controller is configured to detect the presence of the cover. For example, the cover may include a tag, which is detected by the controller, with the controller detecting the presence of the cover based on a signal from the tag.

In another aspect, the controller is configured to generate a display when the cover has been mounted to the barrier for a preselected period of time or when the cover has been mounted to the barrier for a time period that exceeds a preselected period of time.

According to yet another aspect, the barrier comprises a side rail. The side rail includes a side rail body and a side rail mounting mechanism for mounting the side rail body adjacent the support surface. The cover covers at least a portion of the side of the side rail body or an upper edge of the side rail body.

In yet another aspect, the side rail body includes an opening, and the cover includes an opening aligning with the opening of the side rail body.

In another embodiment, a method of making a cover for a patient support barrier includes molding the cover. For example, the method includes providing a mold dimensioned to be smaller than the component to be covered. The mold is then dipped into a bath of an elastomeric material, such as liquid or molten nitrile or latex. After the mold is removed from the bath, the elastomeric material is dried on the mold. The elastomeric material is then removed from the mold after the elastomeric material has dried.

In one aspect, the elastomer is dried by dipping the mold in a hot water bath.

Once dried, the cover may be removed from the mold using air.

In a further aspect, the mold has a size in a range of ⅕ to ⅞ of the size of the component being covered.

Optionally, the mold has a size in a range of ¼ to ¾ of the size of the component.

In yet another embodiment, a method of covering a component includes forming a cover with elastic properties. The cover is formed with a dimension smaller than the component to be covered. The cover is then stretched to a size sufficient to extend over the component and then placed over the component. When placed over the component, the cover is released wherein the cover conforms to the component with a resilient, elastic force.

In one aspect, the cover is a nitrile or latex cover.

Accordingly, the present disclosure describes a cover that will limit, if not prevent, transmission of bacteria and/or viruses by forming a sterile barrier over the underlying component that is easy to place and then remove for replacement with a new cover.

Before the embodiments of the disclosure are explained in detail, it is to be understood that the disclosure is not limited to the details of operation or to the details of construction and the arrangement of the components set forth in the following description or illustrated in the drawings. The cover may be implemented in various other embodiments and is capable of being practiced or carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE DRAWINGS

DETAILED DESCRIPTION OF THE EMBODIMENTS

Figure 1:
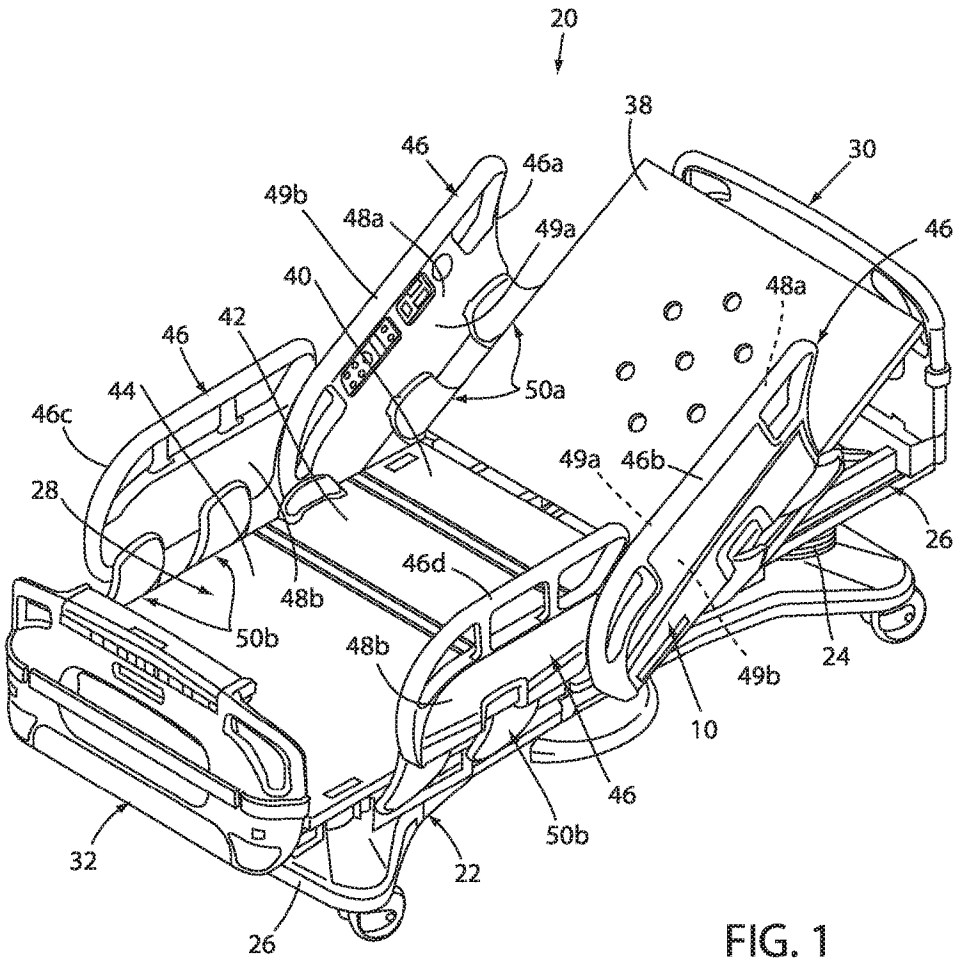
FIG. 1 is a perspective view of a medical apparatus in the form of a hospital bed illustrating one of the side rails covered by a cover.

Referring to FIG. 1, the numeral 10 generally designates a cover for a component of a medical apparatus 20. In the illustrated embodiment, apparatus 20 is a patient support apparatus in the form of a hospital bed, including an intensive care (ICU) bed, MedSurg bed, or a maternity bed, and cover 10 is configured to cover the head-end side rail. However, it should be understood that the medical apparatus may comprise other apparatuses, such as a stretcher, cot, chair, including a medical recliner chair or wheelchair, or an operating room table. Further, cover 10 may be configured for covering a portion or portions of other medical apparatuses used in a medical setting, such as carts, treatment devices, including temperature management apparatuses, or the like. Although illustrated herein as covering a head-end side rail, cover 10 may be configured to cover other components of the patient support apparatus barrier, e.g. the headboard, the footboard, and/or foot-end side rails. Further, as will be more fully described below in reference to covers 110, 210 (FIGS. 5-10), the cover may be configured to cover only a portion of the respective barrier. For ease of description, reference will be made to a single cover 10, but it should be understood that multiple covers may be used on a respective patient support apparatus, including one for each side rail.

Referring again to FIG. 1, patient support apparatus 20 includes a base 22, a pair of elevation adjustment mechanisms 24 (only one show), a frame or litter assembly 26, a deck 28, which forms part of the patient support surface, and a barrier. Elevation adjustment mechanisms 24 are adapted to raise and lower frame 26 with respect to base 22. Elevation adjustment mechanisms 24 may be hydraulic actuators, electric actuators, or any other suitable device for raising and lowering frame 26 with respect to base 22. In some embodiments, elevation adjustment mechanisms 24 operate independently so that the orientation of frame 26 with respect to base 22 may also be adjusted between, for example, a Trendelenburg ("Trend") position and a reverse Trendelenburg ("reverse Trend") position.

Frame 26 provides a structure for supporting deck 28 and the barrier. Deck 28 provides a surface on which a mattress, or other cushion, is positionable so that a patient may lie and/or sit thereon. Deck 28 may be made of a plurality of sections, some of which are pivotable about generally horizontal pivot axes. In the illustrated embodiment shown in FIG. 1, deck 28 includes a head section 38, a seat section 40, a thigh section 42, and a foot section 44. Head section 38, which is also sometimes referred to as a Fowler section, is pivotable between a generally horizontal orientation and a plurality of raised positions (one of which is shown in FIG. 1). Thigh section 42 and foot section 44 may also be pivotable in some embodiments.

The barrier includes a headboard 30, a footboard 32, and side rails 46. In the illustrated embodiment, the headboard 30 and footboard 32 both mount to frame 26, while the side rails 46 mount to the deck so that the side rails move with the respective deck sections. It should be understood that the side rails may instead mount to the frame. In the illustrated embodiment, patient support apparatus 20 includes four side rails 46, namely a left head-end side rail 46*a*, a left foot-end side rail 46*c*, a right head-end side rail 46*b*, and a right foot-end side rail 46*d*. Side rails 46 each include a side rail body 48*a*, 48*b* and a side rail mounting mechanism 50*a*, 50*b* for mounting the respective side rail bodies to the deck such that they are movable between a raised position (such as the configuration shown in FIG. 1) and a lowered position. It should be understood that the number of side rails can vary. For example, when the patient support apparatus is configured as a stretcher, chair, etc., the patient support apparatus may include two barriers, such as two side rails or two arms.

For examples of the construction of base 22, elevation adjustment mechanisms 24, frame 26, deck 28, headboard 30, footboard 32, and/or side rails 46 reference is made to U.S. Pat. No. 7,690,059 issued to Lemire et al., and entitled HOSPITAL BED, the complete disclosure of which is incorporated herein by reference; or as disclosed in commonly assigned U.S. Pat. No. 8,689,376, commonly owned by Stryker Corp. of Kalamazoo, Mich., the complete disclosure of which is also hereby incorporated herein by reference; or as embodied in the commercially available S3 bed sold by Stryker Corporation of Kalamazoo, Mich., and documented in the Stryker Maintenance Manual for Stryker's MedSurg Bed, Model 3002 S3, (doc. 3006-109-002 Rev D), published in 2010, the complete disclosure of which is also hereby incorporated herein by reference. However, it should be understood that the construction of base 22, elevation adjustment mechanisms 24, frame 26, deck 28, headboard 30, footboard 32 and/or side rails 46 may also take on forms different from what is disclosed in these documents.

As will be described more fully below, patient support apparatus 20 may include a control system (60, FIG. 1A) with electronics and a system for detecting the presence or the mounting of the cover to the side rail and/or monitoring the use of the cover, and/or alerting a caregiver to the need to use or replace a cover.

Cover 10 is formed from a sheet of flexible, elastic material so that it can be stretched from an uninstalled configuration to an installation configuration, and then released to an installed configuration. Cover 10 is formed by molding, such as dipping, blow molding, or injection molding. In each case, the mold is sized such that the cover 10 has a first configuration, which is smaller than the component being covered, but is formed from a sheet material having sufficient flexibility and elasticity to stretch from its first configuration (its uninstalled configuration) where the cover is insufficient in size to cover the component to a second configuration (its installed configuration) where the cover is sufficient in size to cover the component.

Further, because of the elastic nature of the material forming cover 10, when cover 10 is released onto the component, cover 10 will generate an inward spring force so that cover 10 will cling to the component to which it is mounted under the spring force generated in the cover itself. For example, a suitable material is nitrile, such as nitrile rubber, or latex.

As noted above, in the illustrated embodiment, the component covered by cover 10 is a hospital bed head-end side rail 46*b*. Further, cover 10 is sized so that when it is stretched and mounted on side rail 46*b* it covers the inwardly facing and outwardly facing sides 49*a*, 49*b* of side rail body 48*b*.

Figure 2:
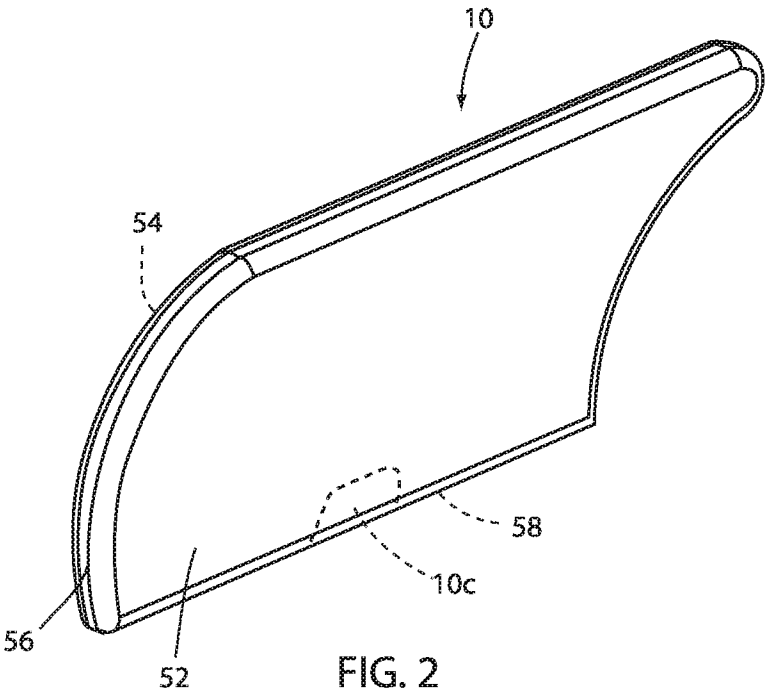
FIG. 2 is a perspective view of the cover in FIG. 1.
Figure 4:
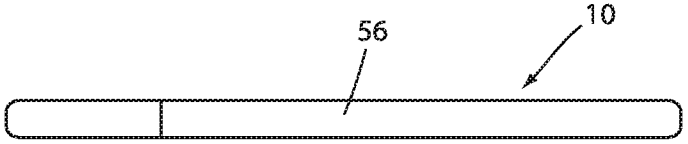
FIG. 4 is a top plan view of the cover.

Referring to FIG. 2, cover 10 includes two spaced apart sides 52, 54 that are, in the illustrated embodiment, dimensioned or sized so that they completely cover the inwardly and outwardly facing sides 49*a*, 49*b* of body 48*b*. Optionally, sides 49*a*, 49*b* may be only partially covered. Sides 52, 54 are joined together at their opposed ends and upper edge by an interconnecting perimeter wall 56, leaving the lower edges of each side 52, 54 detached to form an opening 58 for receiving the respective side wall. As described above, cover 10 is formed so that it is smaller in dimension (at least along one axis, for example along its long axis) than side rail 46*b*, but when stretched can be placed over the side rail body so that opening 58 allows the side rail body to be inserted into the cover (in other words, the cover placed over the side rail body). Once positioned, the cover can be released so that it elastically conforms to the side rail body.

The cover may be color-coded, for example to provide a functional flag. For example, the material forming the cover may have pigments suspended therein to form the color. The functional flag may provide an indication of a condition or status of a patent. For example, a color may be used to indicate when a patient is highly contagious or some other condition of a patient. Other conditions may include a risk condition of a patient. For example, a color may be used to visually indicate to a caregiver that the patient is a high risk for falling or other risk factor or has just gone through surgery, or some other condition or status.

In one embodiment, the cover may include a tag, such as an electronic tag or a bar code or a quick response (QR) code, which may be used to identify the cover or be used to detect its presence, for example. In one embodiment, the cover may include an RFID tag that can be read either by the bed-based computer described below or by a hand-held device. The RFID tag may be used for inventory purposes or for monitoring how long a cover has been on the side rail to determine whether it needs to be removed and replaced with a new cover. For further description of detecting the presence or monitoring of the use of a cover, and alerting a caregiver when to replace a cover, reference is made to the description of FIG. 1A below. Similarly, a caregiver may use a hand-held device with a bar code or QR code reader to read the tag on the cover. Optionally, the bar or QR code reader may be in communication with the bed-based computer or a remote computer to upload information about the cover to the computer in a similar manner described in reference to FIG. 1A.

In another embodiment, the sheet forming the cover may include a chemical that has a first state and a second state, with the chemical changing between the first state and the second state in response to an input. For example, the states may be different colors, different opacity, luminescence, or the like.

In one embodiment, the input comprises a passage of time. Suitable chemicals include pheyl oxalate, fluorescent dye and hydrogen peroxide, which when mixed together emit light for a predetermined period of time. For example, the predetermined time period may be a few hours to a few days. Accordingly, each of the chemical components may be separately located in the cover, for example in frangible nesting bladders or pockets or pouches during the forming process. Alternately, the chemicals can be provided in the form of beads that when crushed or broken release the chemicals so that they can mix together to effect the change in color for a region of the cover or for the whole cover. In either case, once the cover is stretched or compressed, and the bladders or beads have ruptured, the chemicals will mix together to emit light at least in a section of the cover, which light will, after the predetermined period of time, no longer be emitted.

In another example, the covers described herein may include a migrating ink. For example, the covers described herein may be formed from a base film on which ink is applied. The ink may include both migrating ink and non-migrating or low migrating ink. Migrating ink refers to ink that has chemicals that migrate through penetration, contact, evaporation, and/or condensation. The covers may also then include an overlying film, such as an opaque film, which is adhered to the base layer, using, for example, a transparent adhesive. Additional transparent films may be applied to the overlying film.

In operation, the migrating ink migrates from the base layer through the adhesive to the overlying layer, so that the migrating ink is visible at the cover. This occurs over a given or predetermined period of time. In this manner, the migration of the ink through to the overlying film which, would be visible to a person viewing the cover, may be used to indicate that the cover needs replacement. The predetermined time period is controlled by the selection of the ink, the adhesive, and the overlying film.

In yet another example, the covers described herein may incorporate a time sensitive ink or dye the changes color over a predetermined time period. For example, the predetermined time period may also be a few hours to a few days. Suitable time sensitive inks or dyes include inks or dyes made from semiconductors, such as titanium dioxide, which when oxidized change color. For example, the cover may be contained in vacuum packaging. When the packaging is opened and the cover removed to apply to the barrier, the cover is then exposed to air. After a predetermined period of time, the cover will then change color. This change in color, as noted, may be used to indicate when the cover needs (or is recommended) to be changed.

In other embodiments, the inks or dyes may be U-V activated.

In each case, the change in color, including loss of color, may be used to indicate when it is time to replace the cover.

So for example, rather than electronically monitoring how long the cover has been mounted, the cover may be visually monitored. For example, the cover may change color, opacity, or luminescence after a predetermined period of time so that the caregiver (or a device) may simply observe the color change, which will alert the caregiver (or device) of the need to change the cover.

In another example, as noted, a device may monitor the change in state of the cover. For example, the device may comprise an in-room optical system, such as a camera, or the bed itself. For example, the bed may include a sensor, such as an image sensor, including a CMOS or a CCD sensor, which may be located in the side rail facing the inner surface of the cover or in the head board or foot board and positioned to face the cover. The sensor is in communication with the bed-based computer described below, which then uses the signals from the sensor to determine when the cover needs to be changed. For more detail, reference is made below to the description of the bed-based computer in reference to FIG. 1A.

In another aspect, the cover is transparent or translucent. In this manner, a caregiver can see and use the various controls mounted on the side rail. As noted above, cover 10 is formed from a flexible sheet of material, such as nitrile or latex. In one embodiment, the cover has a thickness in a range of 3 mils to 12 mils, so that a caregiver and/or patient can still feel and operate the various controls in the side rail.

Further, by forming the cover from a material such as nitrile or latex, cover 10 is disposable and therefore can be frequently changed to reduce the chances of transmitting bacteria or viruses. In one embodiment, the patient support apparatus may include a dispenser for holding covers, so that when a cover needs to be replaced, for example, when a new patient is assigned to the patient support apparatus or before or after a patient receives a visitor or simply when a sufficient passage of time has elapsed, as dictated by a protocol.

Other optional features include the cover having a scent. The scent can be a soothing scent, which may help with calming some patients.

In one embodiment, the side rail body includes one or more openings 49*c*, 49*d*, and the cover includes one or more corresponding openings 10*a*, 10*b* that align with the opening(s) of the side rail body. Optionally, the openings 10*a*, 10*b* may be formed with reinforcement, such as a rib, to reduce the likelihood of tearing the cover when being stretched and placed over the side rail body. Alternately, cover 10 may include recessed areas, such as at a lower edge thereof, to accommodate features of the side rail. For example, cover 10 may include a recessed area (i.e., a cut out or absence of material) 10*c* at the lower edge of sheet 54 to accommodate the side rail release mechanism.

Figure 1A:
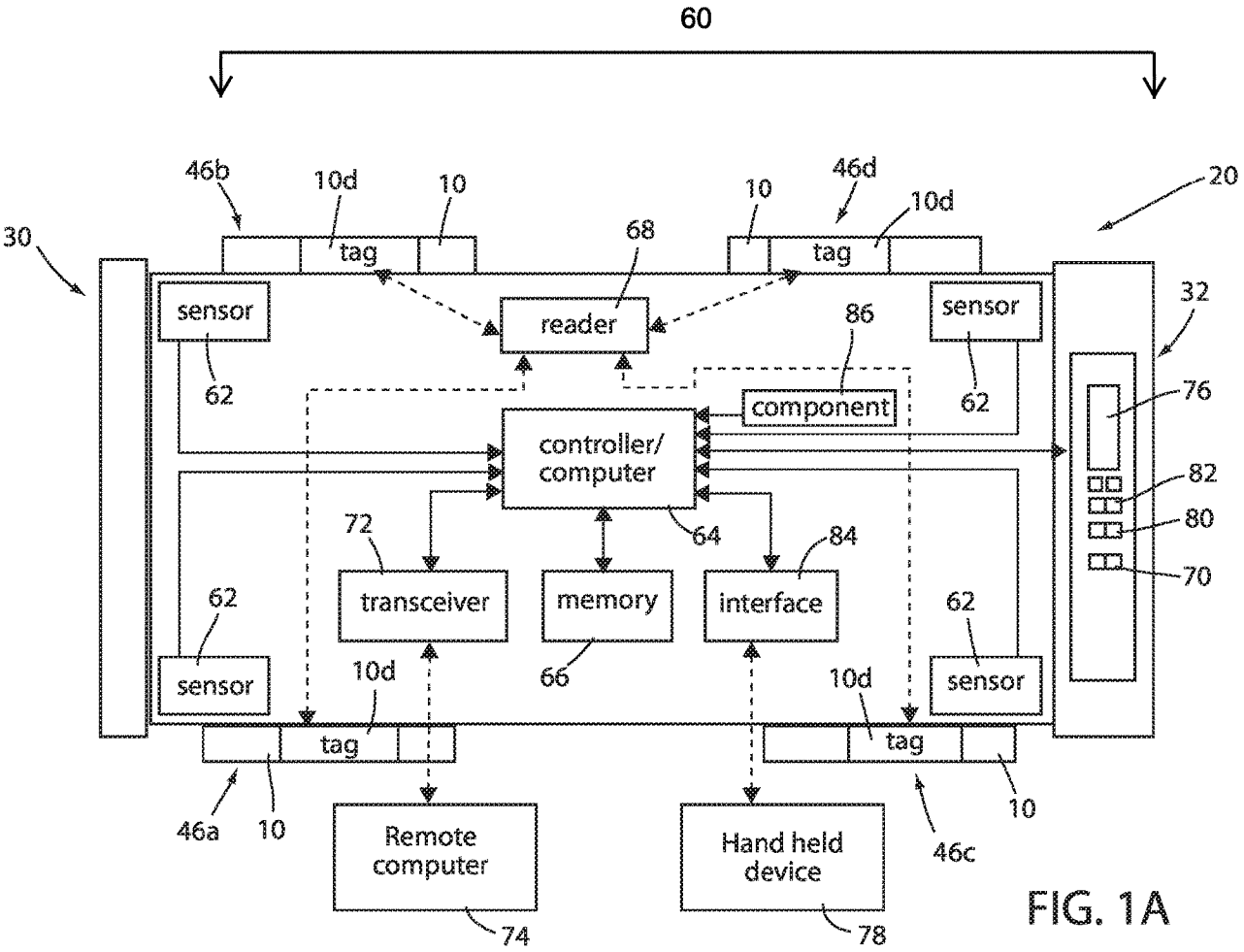
FIG. 1A is a schematic of a control system for the hospital bed.

Referring to FIG. 1A, the numeral 60 generally designates a control system for medical apparatus 10. As will be more fully described below, control system 60 is configured to detect the presence of cover 10 or detect when the cover is mounted to the component of the medical apparatus, such as when mounted on a side rail 46*b*. The control system may be wired or wireless and, further, may be local, as described below, or may be remote. Although described hereafter in reference to a hospital bed, it should be understood that the control system may be used in conjunction with other types of medical apparatus.

For example, control system 60 may include one or more sensors 62, such as an optical or image sensor, to detect when the cover is mounted to a respective side rail. A sensor may be located in each side rail to detect when the cover 10 is mounted to the respective side rail. The sensor may be in communication with the controller (described below) of the control system wirelessly or may have a wired connection to the controller.

Referring again to FIG. 1A, control system 60 includes a controller 64, with sensor(s) 62 in communication with the controller (as noted, which may be a wired or wireless connection), and memory 66, where information may be stored, for example, a predetermined time period against which the controller may compare the time the cover has been mounted to determine whether the cover needs to be replaced. For example, controller 64 may include a timer, which controller 64 uses to monitor how long the cover or covers have been mounted. Therefore, control system 60 optionally can monitor the use of the covers to manage the use of the covers.

Figure 3:
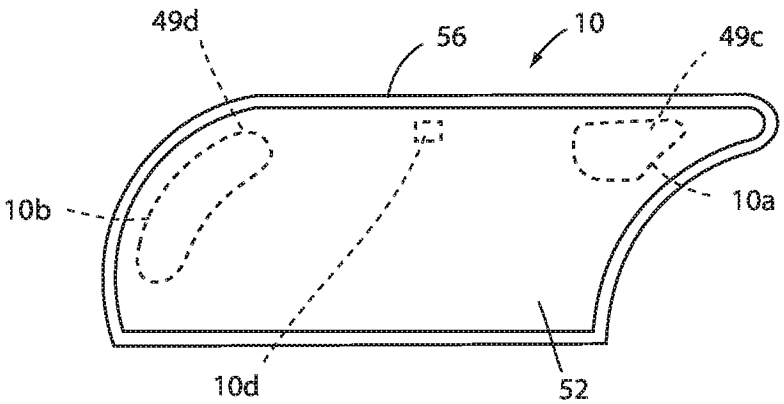
FIG. 3 is an elevation view of the cover.

Optionally, controller 64 may be configured to detect the presence of the cover. For example, each cover 10 may include a tag 10*d* (FIG. 3), such as an RFID tag, and control system 60 may include a tag reader 68, such as an RFID tag reader, that generates a signal and detects the presence of the cover or covers 10 based on the signals received back from the tag or tags in response to the signals from the reader.

Further, controller 64 may be configured to monitor how long the cover or covers have been present so that controller 64 can manage the use of the covers, as noted above. Additionally, controller 64 may be configured to generate a signal in response to determining whether the cover has been mounted to the barrier or present at the barrier for a preselected period of time or when the cover has been mounted or present for a time period that exceeds a preselected period of time. Optionally, the controller is configured to generate an alarm or notification signal when the cover has been mounted to the barrier or has been present for a preselected period of time or when the cover has been mounted to the barrier or present for a time period that exceeds a preselected period of time. The alarm or notification signal may generate a local alarm, such as a light being energized, for example a light 70 mounted at the footboard 32. Alternately or in addition, the alarm may be remote. For example, control system 60 may include a transceiver 72 for sending and receiving signals to and from a remote computer 74, such as a nurse call station or a hospital network, via for example, a hospital server or a third party server. When controller 64 determines that a cover or covers have been present or mounted to the barrier for a predetermined period of time (or for a time period that exceeds the predetermined period of time) controller 64 generates an alarm or notification signal and sends the signal to remote computer 74. In this manner, control system 60 may provide a notification system of when a cover or covers need to be replaced. Alternately, control system 60 may simply receive the signals from the sensor (or tag) and send the signals to the remote computer, which processes the signals to determine the presence or mounting of the cover to the side rail.

In another embodiment, the alarm may be a sound or icon or text generated at a display 76, for example, at the footboard 32.

Optionally, as noted above, cover 10 may change color or luminescence in response to input, such as passage of time. Sensors 62 may be configured to detect the change in color or luminescence of the cover or covers. For example, as noted above, sensors 62 may comprise an image sensor, including a CMOS or a CCD sensor, which may be located in the side rail facing the inner surface of the cover or in the head board or foot board and positioned to face the cover to detect when there is a change in color. Sensors 62 may be located in any suitable location, including an opposite side rail, deck, footboard or headboard, as noted, or even off the bed, such as on an adjacent wall or the ceiling, that can monitor the change in color of the cover. When a change in color is detected by the sensor or sensors, which are in communication with controller 64, sensors 62 will generate a detection signal, and in response controller 64 will generate an alarm or notification signal as noted above. As noted above, the detection signals input to the control system 60 may be via an in-room optical system instead. Similarly, the signals from sensors 62 may be transmitted to the bed-based controller and then forwarded off the bed to another computer for remote processing.

Alternately, cover 10 may provide a non-electronic based notification system in the form of a visual notification system wherein a caregiver is notified by simply observing the change in the cover, as noted above.

In another embodiment, the status of cover or covers 10 may be monitored based on input to the controller from a caregiver or a hand-held device 78. For example, footboard 32 may include a control panel 82, which may include display 76 and light 70 noted above. Further, control panel 82 may include user input devices, such as buttons. One or more of the buttons may comprise a "new cover" button 82 and may be used by a caregiver to input to controller 64 a signal indicating that a new cover has just been installed. After receiving the signal from the "new cover" button, controller 64 is configured to generate an alarm or notification signal after a predetermined period of time has elapsed (as measured by the timer), unless for example, a caregiver again inputs via new cover button 82 that the cover has been replaced and a new cover has been installed, which causes controller 64 to reset the timer.

As noted above, input to controller 64 may also be provided by hand-held device 78. For example, hand-held device 78 may include a tag (RFID tag or bar code or QR code) reader, which may be coupled to controller 64 via an interface 84, such as a USB port or a receiver. A caregiver may use hand-held device 78 to check the status of cover or covers 10 by reading the tag (RFID tag or bar code or QR code) 10*d* or to associate the cover or covers 10 with the bed. For example, tag 10*d* may include information about the cover, such as a serial number or a time stamp, which can be used to determine how long the cover has been installed. Again, once to the cover has been associated with the bed, controller 64 is configured to monitor how long the cover has been mounted to the side rail.

Although not described herein, it should be understood that control system 60 may comprise a bed control system for controlling and/or monitoring one or more bed components 86 or may comprise a separate control system.

The components of control system 60 communicate with each other using conventional electronic communication techniques. In one embodiment, controller 64 communicates with memory 66, control panel 80, reader 68, transceiver 72, and interface 84 using I-squared-C communications. Other types of serial or parallel communication can alternatively be used. In some other embodiments, different methods may be used for different components. For example, in one embodiment, controller 64 communicates with user interface 84 via a Controller Area Network (CAN) or local Interconnect Network (LIN), while it communicates with memory 66, and components 86 using I-squared-C. Still other variations are possible.

As noted above, control panel 80 may include a plurality of buttons at display 76. The buttons and/or display 76 (e.g. when provided as a touchscreen display) may be configured to allow a caregiver to press or touch in order to control various features of the patient support apparatus, such as, but not limited to, raising and lowering the height of frame 26 via lift mechanisms 24, pivoting one or more sections of deck 28 via one or more deck actuators, turning on and off a brake (not shown) via a brake actuator, controlling a scale system integrated into the patient support apparatus 20, controlling an exit alert system integrated into the support apparatus 20, and/or controlling other features of the patient support apparatus 20. As noted display 76 may comprise a touchscreen display capable of displaying text and/or graphics and sensing the location that a user's finger touches the display, although it will be understood that display 76 could be modified to be a normal LCD display without touchscreen capabilities that use hard or soft buttons to interact therewith, or still other types of displays. Further, as will be more fully described below, display 76, may be configured to provide a menu for selecting features and icons to indicate when an application is enabled at the patient support apparatus, for example, when it has been authorized for use, or when it is disabled.

Controller 64 includes one or more microcontrollers, microprocessors, and/or other programmable electronics that are programmed to carry out the functions described herein. It will be understood that controller 64 may also include software and other electronic components that are programmed to carry out the functions described herein, or that support the microcontrollers, microprocessors, and/or other electronics. The other electronic components include, but are not limited to, one or more field programmable gate arrays, systems on a chip, volatile or nonvolatile memory, discrete circuitry, integrated circuits, application specific integrated circuits (ASICs) and/or other hardware, software, or firmware, as would be known to one of ordinary skill in the art. Such components can be physically configured in any suitable manner, such as by mounting them to one or more circuit boards, or arranging them in other manners, whether combined into a single unit or distributed across multiple units. Such components may be physically distributed in different positions on patient support apparatus 20, or they may reside in a common location on patient support apparatus 20. When physically distributed, the components may communicate using any suitable serial or parallel communication protocol, such as, but not limited to, CAN, LIN, Firewire, I-squared-C, RS-232, RS-485, etc.

Figure 5:
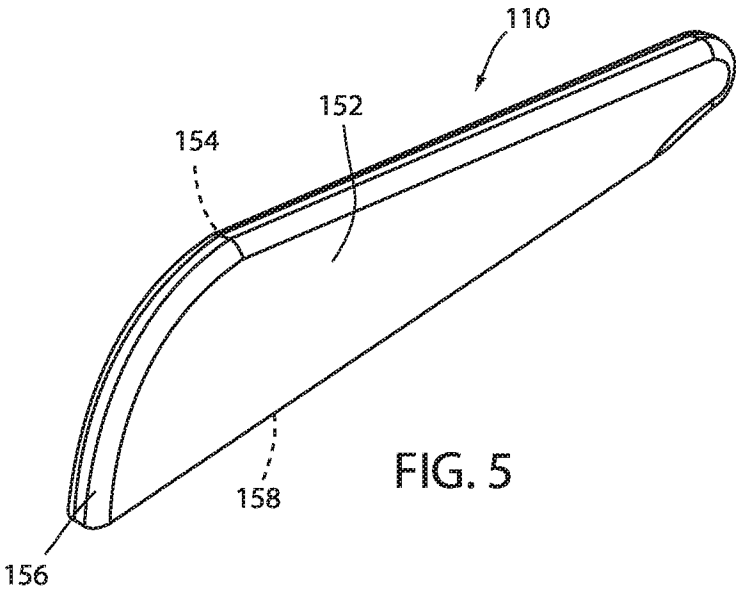
FIG. 5 is a perspective view of another embodiment of a cover.
Figure 6:
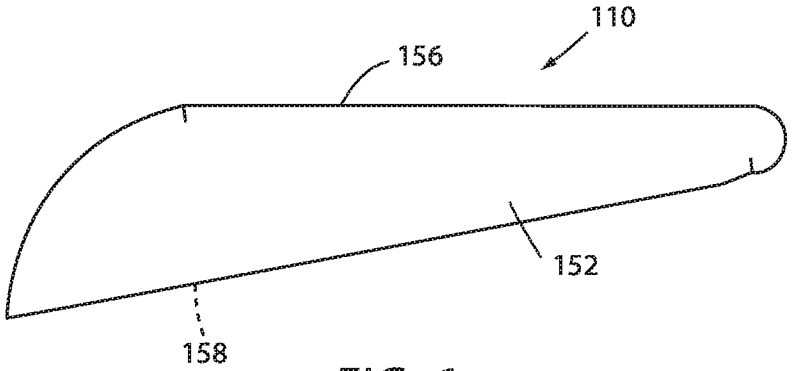
FIG. 6 is an elevation view of the cover of FIG. 5.
Figure 7:
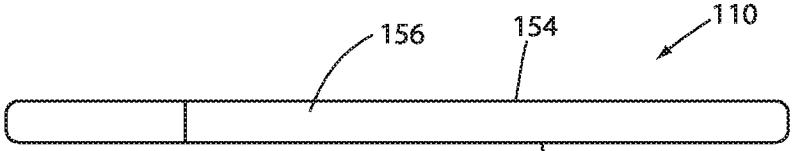
FIG. 7 is a top plan view of the cover of FIG. 6.

Referring to FIGS. 5-7, the numeral 110 generally designates another embodiment of a cover. In the illustrated embodiment, cover 110 is configured so that it covers just a portion of the component, namely the upper edge and foot-end portion of side rail 46*b*. In the illustrated embodiment, cover 110 is formed from a sheet of material similar to cover 10 and includes two spaced apart sides 152, 154, which are joined together at their opposed ends and upper edge by an interconnecting perimeter wall 156, leaving the lower edges of each side 152, 154 detached to form an opening 158. Similar to the previous embodiment, cover 110 is formed so that it is smaller in dimension than side rail 46*b* (along at least one axis, for example the long axis of the cover), but when stretched can be placed over the side rail body so that opening 158 allows the side rail body to be inserted into the cover (in other words, the cover placed over the side rail body). Once positioned, the cover can be released so that it conforms to the side rail body.

As noted, in the illustrated embodiment cover 110 covers a portion of side rail body 48*a* of side rail 46*b*. Further sides 152, 154 of cover 110 are tapered along their lower edges to form a generally triangular or trapezoidal shaped cover, with the greater portion of the cover concentrated on one end, such as the foot-end of side rail 46*b* where there is likely a greater number of touch points than at the head-end of side rail 46*b*. For further optional details of cover 110, reference is made to cover 10.

Figure 8:
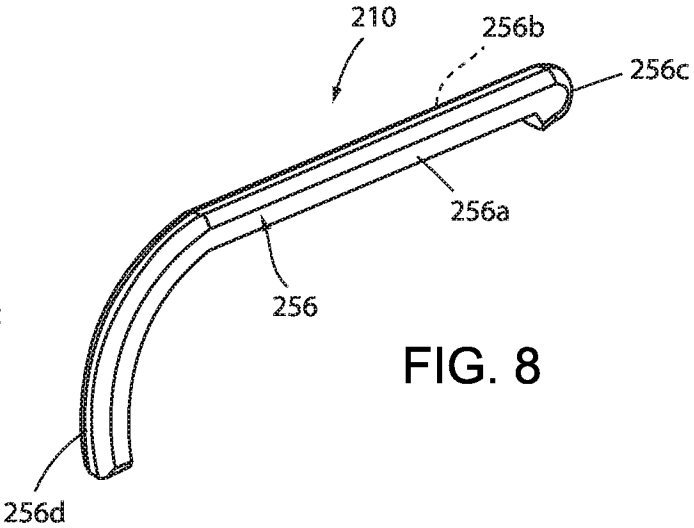
FIG. 8 is a perspective view of another embodiment of a cover.
Figure 10:
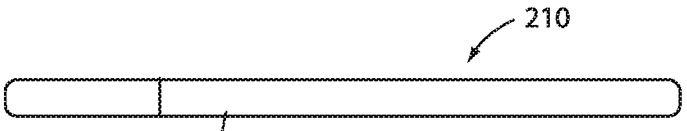
FIG. 10 is a top plan view of the cover of FIG. 9.
Figure 9:
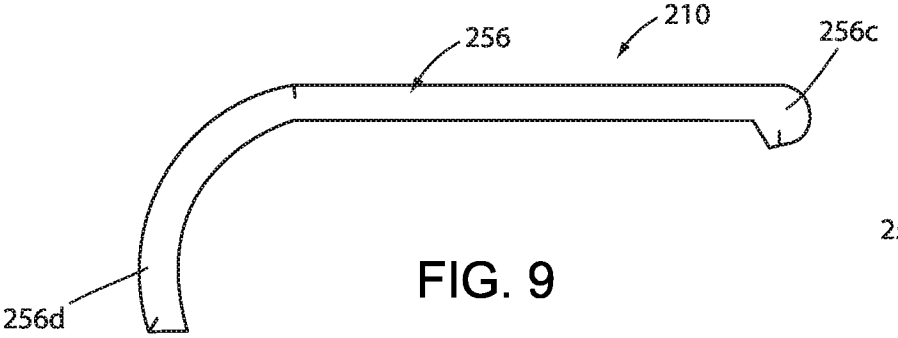
FIG. 9 is an elevation view of the cover of FIG. 8.

Referring to FIGS. 8-10, the numeral 210 generally designates another embodiment of a cover. In the illustrated embodiment, cover 210 is configured to cover the upper edge of side rail 46*b*. Cover 210 is formed by an elongated narrow panel 256 of material similar to cover 10, which includes downwardly depending portions 256*a*, 256*b* that wrap around the upper edge of the body 48*a* of side rail 46*b*, where the highest number of touch points typically occur. The length of depending portions 256*a*, 256*b* may vary but optionally at least cover the entire gripping surface area of side rail 46*b*. The length of panel 256 may vary but optionally includes a first curved end 256*c* that covers the upper perimeter portion of the head-end side of side rail body 48*a*. Further, panel 256 may have a sufficient length (when stretched) to include a second curved end 256*d* that covers the full perimeter portion of the foot-end side of side rail body 48*a*. For further optional details of cover 210, reference is made to cover 10.

As noted above, covers 10, 110, or 210, may be formed by molding. For example, covers 10, 110 or 210 may be molded from nitrile or latex by blow molding, dipping, or injection molding the cover into a desired shape that is smaller than the component that is to be covered. In each case, the mold is sized so that it has at least one dimension along an axis that is smaller than the dimension of the corresponding axis of the component. For example, the length of the mold in the long direction is smaller than the dimension of the corresponding axis of the side rail body. Optionally, the mold dimensions along both horizontal axes are smaller than the dimensions of the corresponding axes of the component. For example, the vertical dimension of the mold may be equal to the desired installed height of the cover so that the cover need only be stretched along its length, and optionally also along its width in order to install the cover on the side rail.

Optionally, the mold has a size along at least one axis that is a fraction of the size of the component. For example, in one embodiment, the mold has a size along at least one axis that is in a range of ⅕ to ⅞ of the size of the component along the corresponding axis. Optionally, the mold has a size along at least one axis in a range of ¼ to ¾ of the size of the component along the corresponding axis.

In one embodiment, the method includes providing a mold dimensioned to be smaller than the component to be covered. The mold is then dipped into a bath of an elastomeric material, such as liquid or molten nitrile or latex. After the mold is removed from the bath, the elastomeric material is dried on the mold. The elastomeric material is then removed from the mold after the elastomeric material has dried. Once dried, the cover may be removed from the mold using air.

In one aspect, the elastomer is dried by dipping the mold in a hot water bath.

Various alterations and changes can be made to any of the foregoing embodiments without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

We claim:

1. A cover for covering at least a portion of a hospital bed barrier, said cover comprising:

a sheet of material comprising an elastomer, said sheet having sufficient flexibility and elasticity to stretch from an uninstalled configuration to an installation configuration and then released to an installed configuration wherein when in said uninstalled configuration said cover is dimensioned to be smaller and have an insufficient size to cover an intended portion of a hospital bed barrier and when in said installation configuration said cover is expanded to have a sufficient size to be mounted to the intended portion of the hospital bed barrier and cover the intended portion of a hospital bed barrier and when in said installed configuration said sheet generating an inward spring force to closely conform and cling to the shape of the intended portion of the hospital bed barrier.

2. The cover according to claim 1, wherein said elastomer comprises nitrile or a latex.

3. The cover according to claim 1, wherein when in said installation configuration, the sheet is sufficient in size to cover a hospital bed side rail.

4. The cover according to claim 1, wherein said cover is color-coded to provide a functional flag.

5. The cover according to claim 1, wherein said cover includes an electronic tag.

6. The cover according to claim 1, wherein said sheet includes a chemical, said chemical having a first state and a second state, said chemical changing between said first state and said second state in response to an input.

7. The cover according to claim 6, wherein said input comprises a passage of time.

8. The cover according to claim 6, wherein said first state emits a first color, and said second state emits a second color.

9. The cover according to claim 1, wherein said sheet of material includes a luminescent material.

10. The cover according to claim 1, wherein said sheet of material has a thickness in a range of 3 mils to 12 mils wherein a caregiver or patient can still feel and operate various controls in the barrier.

11. The cover according to claim 1, wherein the intended portion is an entire portion of the hospital bed barrier.

12. A patient support comprising:

a support surface;

a barrier mounted adjacent said support surface; and a cover mounted over at least a portion of said barrier, said cover comprising a sheet of material comprising an elastomer, said sheet having sufficient flexibility and elasticity to stretch from an uninstalled configuration to an installation configuration and then released to an installed configuration wherein when in said uninstalled configuration said cover is dimensioned to be smaller and have an insufficient size to cover an intended portion of said barrier and when in said installation configuration said cover is expanded to have a sufficient size to be mounted to said intended portion of said barrier and cover said intended portion of said barrier and when in said installed configuration said sheet generating an inward spring force to closely conform and cling to the shape of said intended portion of said hospital bed barrier.

13. The patient support according to claim 12, further comprising a controller, said controller configured to detect when said cover is mounted to said barrier.

14. The patient support according to claim 13, further comprising a sensor in communication with said controller, said controller detecting when said cover is mounted on said barrier based on a signal from said sensor.

15. The patient support according to claim 13, wherein said controller is configured to detect the presence of said cover at said barrier, wherein said cover includes a tag, said controller configured to detect said tag in order to detect when said cover is present at said barrier.

16. The patient support according to claim 13, wherein said controller is configured to monitor how long the cover has been mounted to said barrier.

17. The patient support according to claim 16, wherein said controller is configured to generate a signal when said cover has been mounted to said barrier for a preselected period of time or when the cover has been mounted to said barrier for a time period that exceeds a preselected period of time.

18. The patient support according to claim 16, wherein said controller is configured to generate a display when said cover has been mounted to said barrier for a preselected period of time or when the cover has been mounted to said barrier for time period that exceeds a preselected period of time.

19. The patient support according to claim 12, wherein said barrier comprises a side rail, said side rail including a side rail body and a side rail mounting mechanism for mounting said side rail body adjacent said support surface.

20. The patient support according to claim 19, wherein said side rail body includes an opening, said cover including an opening aligning with said opening of said side rail body.

21. A method of making a cover of claim 12, said method comprising:

providing a mold dimensioned to be smaller than the intended portion of the hospital bed barrier;

molding the elastomer onto the mold to form the sheet;

curing the elastomer on the mold; and removing the sheet from the mold after the elastomer has cured.

22. The patient support according to claim 12, wherein said intended portion is an entire portion of said barrier.

* * * * *